United States Patent [19]

Baetje

[11] 4,422,275

[45] Dec. 27, 1983

[54] ANCHOR POCKET SYSTEM FOR CUT STONE TRIM AND THE LIKE

[75] Inventor: Kenneth J. Baetje, St. Louis, Mo.

[73] Assignee: Midwest Cut Stone Co., St. Louis, Mo.

[21] Appl. No.: 322,420

[22] Filed: Nov. 18, 1981

[51] Int. Cl.[3] ..... E04B 1/38

[52] U.S. Cl. ..... 52/509; 52/235; 52/704

[58] Field of Search ..... 52/513, 506, 511, 704, 52/510, 235, 509

[56] References Cited

U.S. PATENT DOCUMENTS 3,478,480 11/1969 Swenson ..... 52/235 X 4,021,989 5/1977 Hala ..... 52/235 X

*Primary Examiner*—Carl D. Friedman

*Attorney, Agent, or Firm*—Jerome A. Gross

[57] ABSTRACT

For use in anchoring cut stone trim to building structural members, the present pre-formed tapering rod anchor pockets permit adjustable alignment of the stones on erection, to eliminate re-work at the job site. Rod anchor bolts utilized are of the type having a threaded shank for mounting to the building structure, and a stone-supporting end bent perpendicular thereto. Beneath the edge at which the joint surface of a stone meets its back surface, a tapering cavity is preliminarily formed by drilling converging bores. In the edges a sinkage is then cut whose width is preferably about four times the thickness of such anchor bolt; and the tapering cavity defined by the bores is then cleared to provide the floor and ceiling surfaces. The cavity so formed accommodates the bent supporting end of the anchor bolt. Adjustment of alignment of the stone is achieved by pivoting the rod anchor bolt so that its supporting end extends non-perpendicular to the stone side surface, while the taper of the cavity side walls limits the extent of inadvertent turning of the bolt, which might cause its supporting end to turn out of the cavity.

3 Claims, 5 Drawing Figures

ANCHOR POCKET SYSTEM FOR CUT STONE TRIM AND THE LIKE

FIELD OF THE INVENTION

The present invention relates to the anchoring of cut stone used as trim for buildings, and in particular to the use of threaded bent rod anchors, both for suspension and retention of the stones.

BACKGROUND OF THE INVENTION

Cut stone trim is used extensively in the construction of fine buildings. The variety of its uses and construction methods adapted for each use are shown in several published works. One of the most informative of these is INDIANA LIMESTONE HANDBOOK (1979 Ed.), Indiana Limestone institute of America, Inc.

In the construction of reinforced concrete buildings, the structural members to which cut stone trim is to be attached may include steel members with slotted holes to receive the threaded ends of rod anchor bolts, which are secured with washers and nuts. The unexposed surfaces opposite the larger exposed surface of the stones are referred to as back surfaces; whereas the stone ends to be positioned in alignment adjacent to each other are referred to as the joint surfaces. This terminology is used whether the stones are applied vertically, to be supported by means other than the anchor bolts, which are then used for retention only, or horizontally, that is, actually suspended on the 90° bent supporting ends of the anchor bolts.

The closest prior art known to Applicant is the system, originated by the present Applicant prior to this invention, shown on page 104 of the Indiana Limestone Handbook. That discloses that bent rod anchor bolts may be supported by heavy angles attached to concrete soffit beams. In the system there published, tapering notches are cut into the back surfaces of the stones at the joint surfaces. At the base of each notch a bore is drilled inward, parallel to the back surface of the stone, to receive the 90° bent supporting end of the hanger bolt.

The system there disclosed works advantageously if the structural members, including the attached metal angles, are in perfect alignment. However, substantial variations, say more than one-half inch from side to side, are tolerated in the building structures; whereas for the building trim, no substantial misalignment can be tolerated. Where such misalignment of the structural members exists, it is often necessary to remove one or more trim stones and rework their anchoring provisions at the construction site. This not only results in delays in construction, but greatly increases the expense.

DESCRIPTION OF THE PREFERRED EMBODIMENT

The invention is here explained and illustrated in its use for supporting and aligning the stones of a typical soffit surface; in this utilization the stones are actually suspended by the anchor system hereinafter described. It is likewise useful in the aligned securement of cut stone in other uses, as for the vertical trim around windows; in such uses conventional weight-supporting means are used along with the system presently described.

Figure 1:
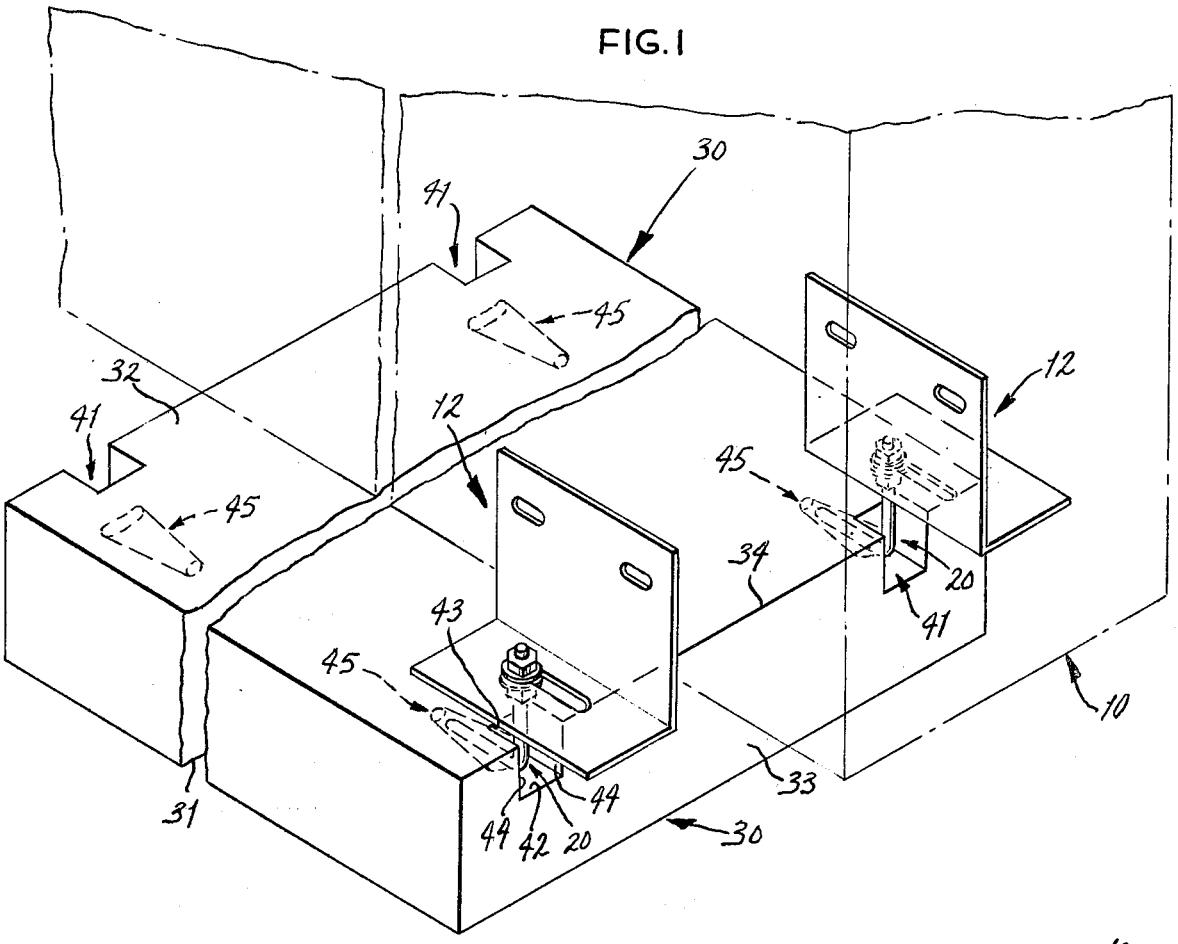
FIG. 1 is a fragmentary perspective view showing a cut stone to be mounted as part of the soffit trim of a building, with bent rod anchor bolts shown in place for suspension from the supporting angles of a structural beam, these being shown in phantom lines.
Figure 2:
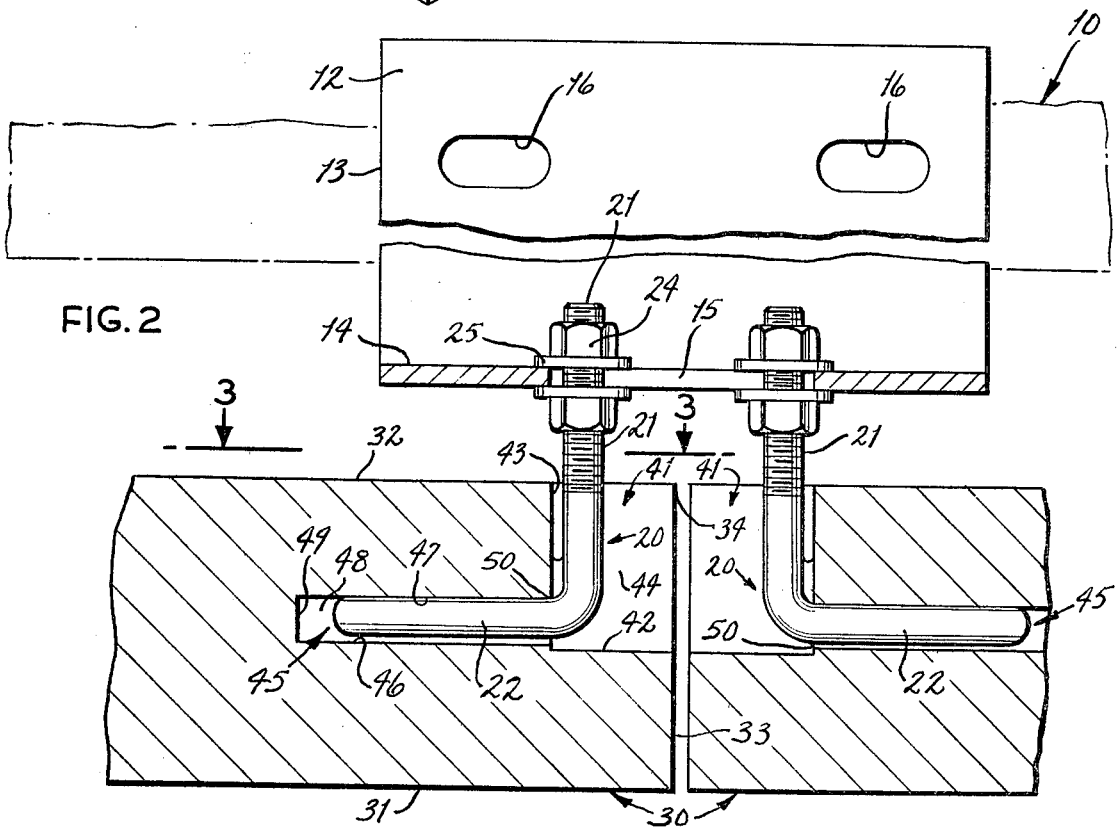
FIG. 2 is a side view partly in section showing details of mounting one end of the cut stone of FIG. 1, together with an adjacent stone, onto such a support angle.

A horizontal beam, such as a structural concrete beam, may be the member from which the soffit trim is to be suspended; such a beam is generally designated 10 in FIGS. 1 and 2. At intervals along its side surfaces, corresponding to the spacing of the ends of cut stones to be supported, are mounted inner and outer support angles 12, 12', best shown in FIG. 2, which extend below the beam 10. Each support angle 12, 12', has a vertical web portion 13, a sideward-extending flange portion 14 equipped with a longitudinal slot 15, and slotted bores 16 in its web, the bores 16 being used for conventional securement to the beam 10. The outer support angle 12' may have an additional outward-facing flange (not shown) to support outer surface trim stones, as is conventional.

The function of the support angles 12, 12', so mounted on the beam 10, is to receive rod anchor bolts generally designated 20 which suspend and support the adjacent ends of two cut stones generally designated 30, hereafter described. Each rod anchor bolt 20 has a threaded shank portion 21, mounted vertically in the slot 15 of the support angle flange 14, and descending to a 90° bent supporting end 22. A typical anchor bolt 20 is formed of stainless steel rod one-half inch in diameter; its shank portion 21 may be of any convenient length, whereas its bent supporting end 22 is preferably about 3" long. Nuts 24 and washers 25 on and about the threaded shank portions 21 above and below the support angle flanges 14 mount the anchor bolts 20 along the slot 15, for angular adjustment as hereinafter disclosed.

A typical cut stone generally designated 30 to be used as soffit trim has an outer surface 31, which when used as a soffit will be its under surface, a back surface 32 which, so used, will be its upward-presented surface, and an end or joint surface 33, which intersects the back surface 32 in a common edge 34, all as best seen in FIGS. 1 and 2. As described to this point, the parts are previously known.

At the juncture of the joint surface 33 with the back surface 32 and along their common edge 34, I provide two anchor pockets spaced apart at such spacing that they may be suspended from supporting angles 12 at opposite sides of the beam 10. Each anchor pocket may be described as being composed of the sinkage generally designated 41 and a tapered cavity generally designated 45. Referring to the detailed parts of the sinkage 41, it has a base surface 42 parallel to the stone back surface 32, an inward-spaced surface 43 parallel to the joint surface 33, and sinkage side surfaces 44, so that the preferred sinkage 41 is substantially rectangular. Preferably the inward extent of the sinkage from the joint surface 33 to the inward-spaced surface 43 is at least two and a half times the thickness of the anchor bolt 20; the width of the sinkage 41 measured along the common edge 34 is preferably greater than three times such thickness; and the depth measured from the stone back surface 32 to the sinkage base surface 42 is preferably greater than three times the thickness of the anchor bolt 20. These dimensions provide certain advantages in use; thus the extent from the joint surface 33 to the inward-spaced surface 43 permits anchor bolts 20 supporting adjacent stones 30 to have washers of conventional size mounted about their threaded shanks 21; and the depth from the back surface 32 to the base surface 42 is necessary for positioning the ceiling of the cavity 45, to be described, sufficiently below the back surface 32 as to provide adequate thickness of stone strength. Except for stones of unusual thickness, the cavity location may advantageously be at about half the thickness of the stone 30 from its back surface 32 to its outer surface 31.

Figure 3:
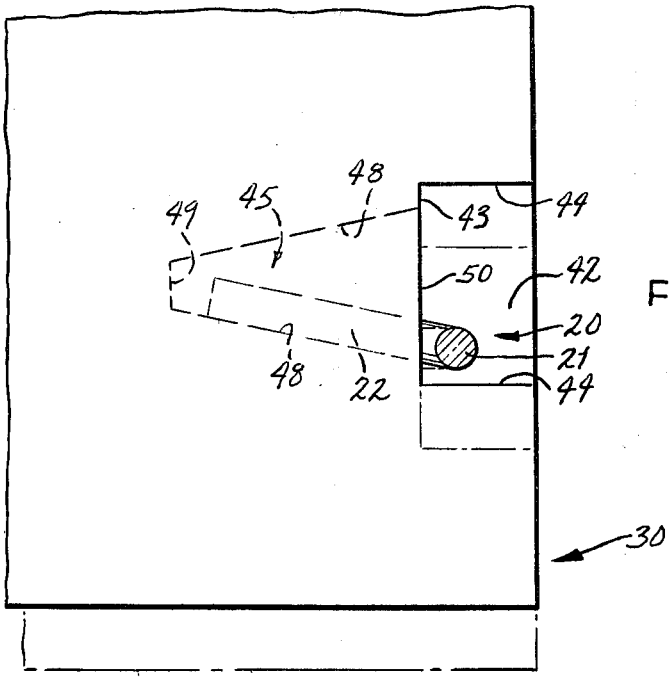
FIG. 3 is a fragmentary sectional view taken along line 3—3 of FIG. 2, the phantom lines illustrating the position of the parts prior to alignment.

Referring now to the tapered cavity 45, it is defined by a floor 46 as seen in FIG. 2, tapered in plan form as seen in FIG. 3; a similar ceiling 47 and tapering side walls 48, which converge toward an inner cavity end surface 49. The cavity floor 46 is at about the same level as the base surface 42 of the sinkage; the cavity ceiling 47 is spaced from the floor 46 by a height sufficiently in excess of the thickness of the rod anchor bolt 20 to provide easy fit of its bent end 22; and the side walls 48 may be rounded as left by the drilling hereafter described. Thus formed, the cavity is seen to extend from a cavity mouth 50, in the inward-spaced sinkage surface 43, to the cavity inner end 49. The cavity mouth 50 is in any event substantially wider than the diameter of the anchor bolt 20, the side walls 48 being spaced at the mouth 50 at least more than twice such bolt thickness and preferably greater than three times as illustrated. However, at the mouth 50 the cavity width is chosen to be less than the length of the bent supporting end 22 of the anchor; this avoids the possibility of inadvertent turning of the bolt supporting end 22 of the cavity 45 when the anchor bolt 20 is angularly adjusted as hereinafter described.

In the preferred embodiment, each of the side walls 48 slants inward from a perpendicular surface 43 at an angle of about 10°. This convergence, taken along with the fact that the spacing of the cavity side walls 48 from each other is less than the length of the rod supporting ends 22, assures adequate projection of the supporting ends 22 into the cavities 45 despite adjusting movements of a stone 30 to achieve its alignment with adjacent stones, as hereinafter described.

Figure 4:
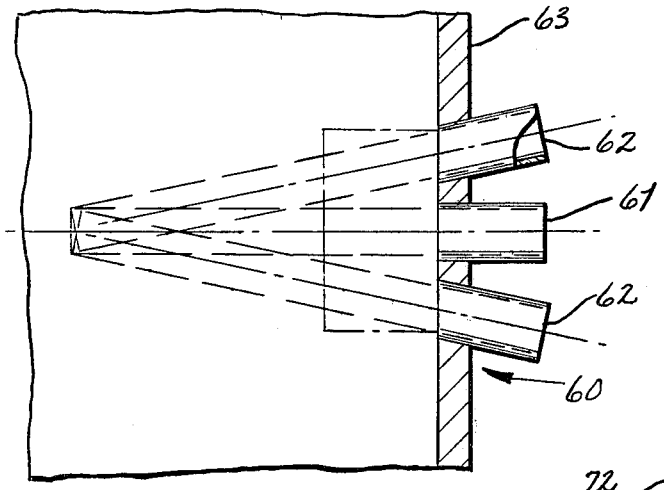
FIG. 4 is a somewhat diagrammatic presentation of steps in preparing an anchor pocket embodying the present invention.

A principal advantage of the present invention is making adequate anchor pockets at the time the stones are prepared, so that no time is wasted in re-work at the construction site. While the anchor pockets may be formed in any convenient manner, I prefer to preliminarily form the tapered cavity 45 by use of a drill jig generally designated 60 shown in FIG. 4. It has a central drill bushing 61 and two other, converging drill bushings 62, each of these being at an angle of approximately 10° to the central drill bushing 61, all being mounted in a bushing mounting plate 63. The axis of the central drill bushing 61 is perpendicular to the mounting plate 63, and the axes of the converging drill bushings 62 are in a common plane with it. By establishing this plane at a depth midway between the floor 46 and the ceiling 47 of the cavity 65 to be formed, and drilling convergingly along the axes as shown in FIG. 4, using a drill and bushings whch are of a diameter equal to the spacing from the cavity floor 46 to ceiling 47, the cavity side walls 48 are formed to final dimension. The floor 46 and the ceiling 47 are then completed by a simple clearing away step.

Figure 5:
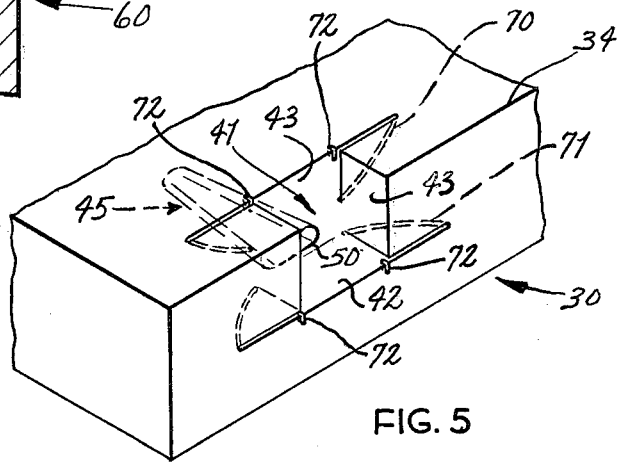
FIG. 5 is a similar presentation of further steps in preparation of such anchor pockets.

A procedure for preparing the sinkage 41 which may be found suitable is illustrated in FIG. 5. A powered circular saw is utilized to cut in an arc 70, as large as is conservatively feasible, to provide the greater part of the inward-spaced surface 43. A similar arcuate cut 71 is made to provide the greater part of the sinkage base surface 42. Smaller arcuate cuts 72 may be made to define portions of the sinkage side surfaces 43. The sinkage is completed by dressing with a chisel, or by other convenient means.

In mounting the cut stones 30 adjacent to each other as shown in FIG. 2, the rod anchor supporting ends 22 are inserted in the tapered cavities 45. Then the anchor bolts 20 are presented substantially upright; the lower nuts and washers 24, 25 are put in place in their threaded shank ends, which are then introduced upwardly through the longitudinal slot 15 in the support angle flange 14; and the upper washers 25 and nuts 24 are preliminarily screwed in place. The lateral alignment of each stone 30 is then checked; the stones are drawn inward or outward so their outward-presented surfaces are in alignment, and the nuts 24 tightened.

If, in the illustration FIG. 3, the shank 21 of the rod anchor bolt 20 was limited to central position the stone 30 might be found to be jutting out from the desired alignment as shown by the phantom lines at the lower part of FIG. 3. Such misalignment (due generally to deviation in exact position of the beam 10) is, with the present invention, readily corrected by moving the stone to the solid line position, rotating the anchor bolt 20 through an angle here shown to be 10°, corresponding with the taper of the cavity side walls 48. In so doing, there is no danger of loss of support; the converging taper of the cavity side walls 48 assures adequacy of the extent of projection of the anchor bolt supporting end 22 into the tapered cavity 45; and in any event, the fact the supporting ends 22 are greater in length than the width of the cavity mouth 50 prevents excessive turning of the rod anchor bolts 20.

The described provisions for adjusting the alignment of cut stones has afforded great saving in time of erection. Preparation of the tapered cavities 45 at the stone-working establishment before shipment avoids what would otherwise be the problem of discovering misalignment on erection, lowering an erected stone, and attempting to re-work it at the construction site. Thus, the enormous cost of delay in construction, due to such misalignment, is avoided.

The specific details and dimensions here given are for guidance. Variations in these, as well as in procedures in manufacture and construction, will be apparent from this disclosure.

I claim:

1. For use as building trim and the like, a cut stone to be supported in alignment with similar stones by a plurality of rod anchor bolts of the type having a threaded shank for bolting to a building structural member and a supporting end bent perpendicular to the shank, the stone having an outer surface to be exposed on erection and having, to be unexposed on erection, a back surface and a joint surface perpendicular thereto and meeting in a common edge, characterized in having, for each of such anchor bolts, an anchor pocket in the common edge and including a sinkage and a cavity extending from the sinkage, said sinkage being of an extent, measured inward from said common edge, at least two and a half times the thickness of such anchor bolt and, measured along said common edge, greater than three times said thickness, and of a depth measured from said back surface greater than three times said thickness, the cavity having a floor and ceiling spaced from each other sufficiently to accommodate the thickness of such supporting end of the rod anchor bolt and having side walls which at the cavity mouth are spaced from each other more than twice such bolt thickness, and in which the spacing of said cavity side walls from each other at the cavity mouth is less than the length of the supporting ends of such rod anchor bolts, whereby on erection to permit adjustment of alignment of the cut stone with adjacent stones.

2. A cut stone as defined in claim 1, in which the spacing of said cavity side walls from each other at the cavity mouth is less than the length of the supporting ends of such rod anchor bolts, and said cavity walls convergingly slope toward each other inward from said cavity mouth, whereby to assure adequate projection of the supporting end of the anchor bolt into the cavity despite adjusting movements of the stone to achieve alignment with adjacent stones.

3. A cut stone as defined in claim 1, in which the extent of the sinkage from the joint surface to the cavity mouth is greater than two and one-half times the thickness of such rod anchor bolt, whereby to provide spacing of anchor bolts supporting adjacent stones which permits use of washers about nuts on the anchor bolt shanks when so bolted to such building structural member.

* * * * *